US006916135B2

(12) United States Patent
Tanaka

(10) Patent No.: US 6,916,135 B2
(45) Date of Patent: Jul. 12, 2005

(54) LEVER-TYPE CONNECTOR

(75) Inventor: Nobuyoshi Tanaka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 16 days.

(21) Appl. No.: 10/434,212

(22) Filed: May 9, 2003

(65) Prior Publication Data

US 2003/0219306 A1 Nov. 27, 2003

(30) Foreign Application Priority Data

May 23, 2002 (JP) ..... 2002-149484

(51) Int. Cl.[7] ..... H01R 13/62

(52) U.S. Cl. ..... 403/322.4; 403/374.5; 439/157

(58) Field of Search ..... 403/322.1, 322.4, 403/373, 374.1, 374.2, 374.4, 374.5, 409.1; 439/157

(56) References Cited

U.S. PATENT DOCUMENTS 5,135,410 A * 8/1992 Kawase et al. ..... 439/157 X
5,252,084 A * 10/1993 Wakata ..... 439/157
5,263,871 A * 11/1993 Sano ..... 439/157
5,476,390 A * 12/1995 Taguchi et al. ..... 439/157
5,603,624 A * 2/1997 Taguchi et al. ..... 439/157
5,611,702 A * 3/1997 Okamoto et al. ..... 439/157
6,439,902 B1 * 8/2002 Cole et al. ..... 439/157

FOREIGN PATENT DOCUMENTS

JP 10-334986 12/1998

* cited by examiner

*Primary Examiner*—Daniel P. Stodola
*Assistant Examiner*—Ryan M. Flandro
(74) *Attorney, Agent, or Firm*—Banner & Witcoff, Ltd.

(57) ABSTRACT

A cam pin (2) is provided on a male connector (1). A cam groove (25) is formed on a lever (15) of a female connector (5). On a bottom surface (30) of a cam part (27) of the cam groove (25), an escape hole (32) is formed at the side of a cam surface (28) for separation, with the escape hole (32) penetrates through an outer wall of a cam plate part (17). The groove width of the cam part (27) is larger than the outer diameter of the cam pin (2). Even though foreign matter such as sand penetrates into the cam groove (25) in a fitted state of the female connector (5) and the male connector (1), the foreign matter can be discharged from the escape hole (32) to the outside of the connector. If some foreign matter does not pass through the escape hole (32) but is left in the cam part (27), the groove width of the cam part (27) is larger than the outer diameter of the cam pin (2) so that the foreign matter does not interfere with a movement of the cam pin (2).

6 Claims, 7 Drawing Sheets

LEVER-TYPE CONNECTOR

BACKGROUND OF THE INVENTION

1. Field of the Invention

The present invention relates to a lever-type connector.

2. Description of the Related Art

A conventional lever-type connector disclosed in Japanese Patent Application Laid-Open No. 10-334986 is described below. The female connector is provided with a lever that pivots on pins disposed on the side surfaces of the female connector. Cam grooves formed on the inner surfaces of the lever receive cam pins of the male connector. The lever is pivoted with the cam pins fitted in the entrance of the cam grooves. In this way, the cam pins are guided into the inward ends of the cam grooves so that the connectors are drawn toward each other and fitted together.

The lever-type connector having the above-described construction is mounted on a two-wheeled vehicle or a buggy. When mounted on a buggy, this connector is susceptible to being clogged by sand or mud. If sand or the like has penetrated into the inward end of the cam grooves from the entrance thereof there is no place for the sand to discharge when the female connector and the male connector are to be separated from each other at a maintenance time by pivoting the lever. Because the sand stays between the cam pins and the surfaces of the cam grooves, the operation of the lever is interfered, which makes it difficult to separate the female connector and the male connector from each other.

SUMMARY OF THE INVENTION

The present invention has been made in view of the above-described situation. Therefore, it is an object of the present invention to provide a lever-type connector in which sand that has penetrated into a cam groove is not retained between a cam pin and a surface of the cam groove when the lever is turned to release the connectors.

To achieve the object, there is preferably provided a lever-type connector comprising a pair of connectors, wherein a cam pin is provided on one of the connectors, and a lever is provided on the other connector. A cam groove capable of receiving the cam pin therein is formed on an inner surface of the lever. The cam pin is guided by operating the lever to allow both connectors to be fitted on each other. An escape hole capable of permitting the escape of foreign matter that has penetrated into the cam groove is formed on an inner surface of the cam groove.

Preferably, the escape hole penetrates through an outer wall of the lever.

Preferably, the cam groove includes a pair of opposed groove surfaces. One of the groove surfaces is formed as a cam surface for insertion and slides against the cam pin in fitting the connectors together. The other of the groove surfaces is formed as a cam surface for separation and slides against the cam pin in separating both connectors from each other. The escape hole is formed at a position near the cam surface for separation.

Preferably, the width of the cam groove is larger than an outer diameter of the cam pin and becomes smaller toward an inward end of the cam groove.

According to the present invention, the escape hole is formed on the inner surface of the cam groove. Thus, even though foreign matter such as sand penetrates into the cam groove, the foreign matter is able to pass through the escape hole from the inner surface of the cam groove. Therefore, when the lever is pivoted to separate the connectors from each other, the foreign matter does not stay between the cam pin and the surface of the cam groove. Consequently, the cam pin can be moved smoothly on the cam groove, which allows operation of the lever and the separation of the connectors from each other.

According to the present invention, the escape hole preferably penetrates through the outer wall of the lever so that the foreign matter that has passed into the escape hole from the inner surface of the cam groove can be discharged to the outside. Thus the foreign matter can be reliably discharged from the cam groove.

According to the present invention, the escape hole is preferably formed at a position near the cam surface for separation. With this construction, it is possible to form the escape hole in a minimized space in solving the problem of the penetration of foreign matter into the cam groove when the operation of separating the connectors. Therefore, it is possible to secure the strength of the lever.

According to the present invention, if some foreign matter does not pass through the escape hole but is left in the cam groove, the groove width of the cam groove is larger than the outer diameter of the cam pin so that the foreign matter does not interfere with movement of the cam pin. Also, since the groove width of the cam groove becomes smaller toward the inward end of the cam groove, the cam pin is not loose in the cam groove in a normal fitted state of the connectors, i.e., when the cam pin is disposed at the inward end of the cam groove.

DETAILED DESCRIPTION OF THE PREFERRED EMBODIMENTS

Figure 1:
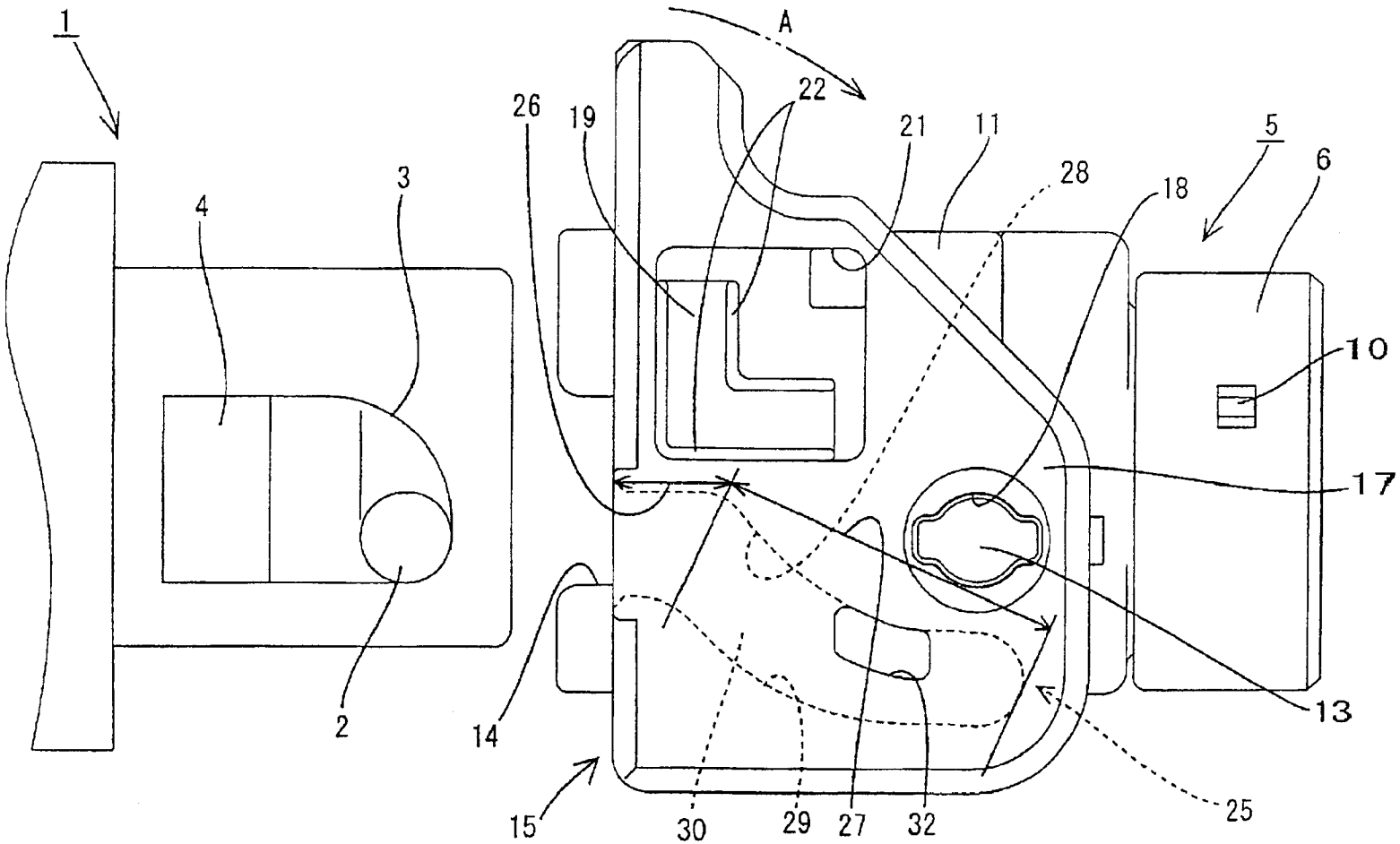
FIG. 1 is a side view showing a state before a female connector and a male connector are fit together according to an embodiment of the present invention.

An embodiment of the present invention will be described below with reference to FIGS. 1 through 7. FIG. 1 shows a lever-type connector with a male connector 1 and a female connector 5.

The male connector 1 accommodates male terminal fittings (not shown). A stand 4 projects from each of the outer walls of the male connector 1. A cam pin 2 projects from an upper surface of each of the stands 4. The front edge of each stand 4 is formed with a generally circular arc to form a release part 3.

The female connector 5 has a body 6, a hood part 11 disposed at the front side of the body 6, and a lever 15 pivotally mounted on the hood part 11.

Figure 3:
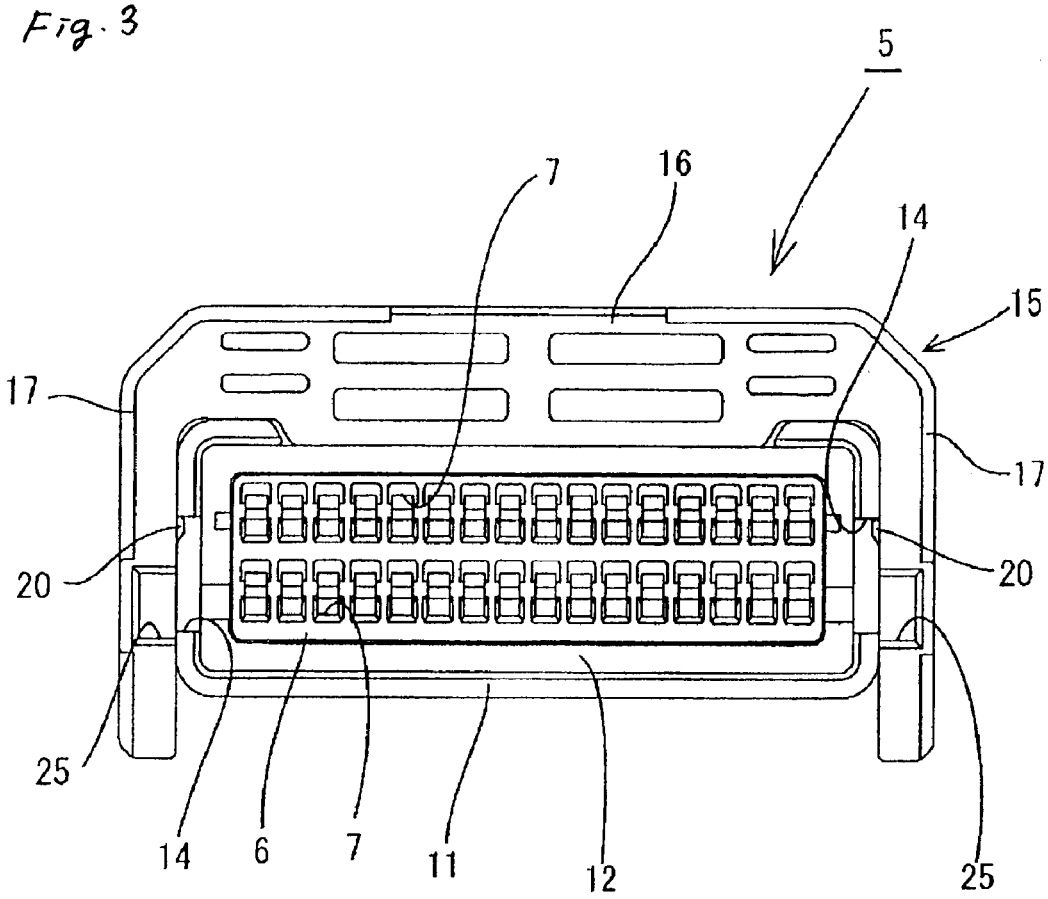
FIG. 3 is a front view showing the female connector.

As shown in FIG. 3, a plurality of cavities 7 capable of accommodating female terminal fittings (not shown) penetrate through the body 6 in a front-to-back direction (i.e., in the fitting direction of the connectors). The female terminal fittings can be inserted into the cavities 7 from openings at the rear end thereof.

As also shown in FIG. 3, the hood part 11 surrounds an outer wall of the body 6 and defines an accommodation space 12 with the outer wall. The male connector 1 can be inserted into the accommodation space 12. A supporting shaft 13 projects from each of the side surfaces of the hood part 11. The lever 15 is installed on the supporting shafts 13 for pivotal movement.

Figure 2:
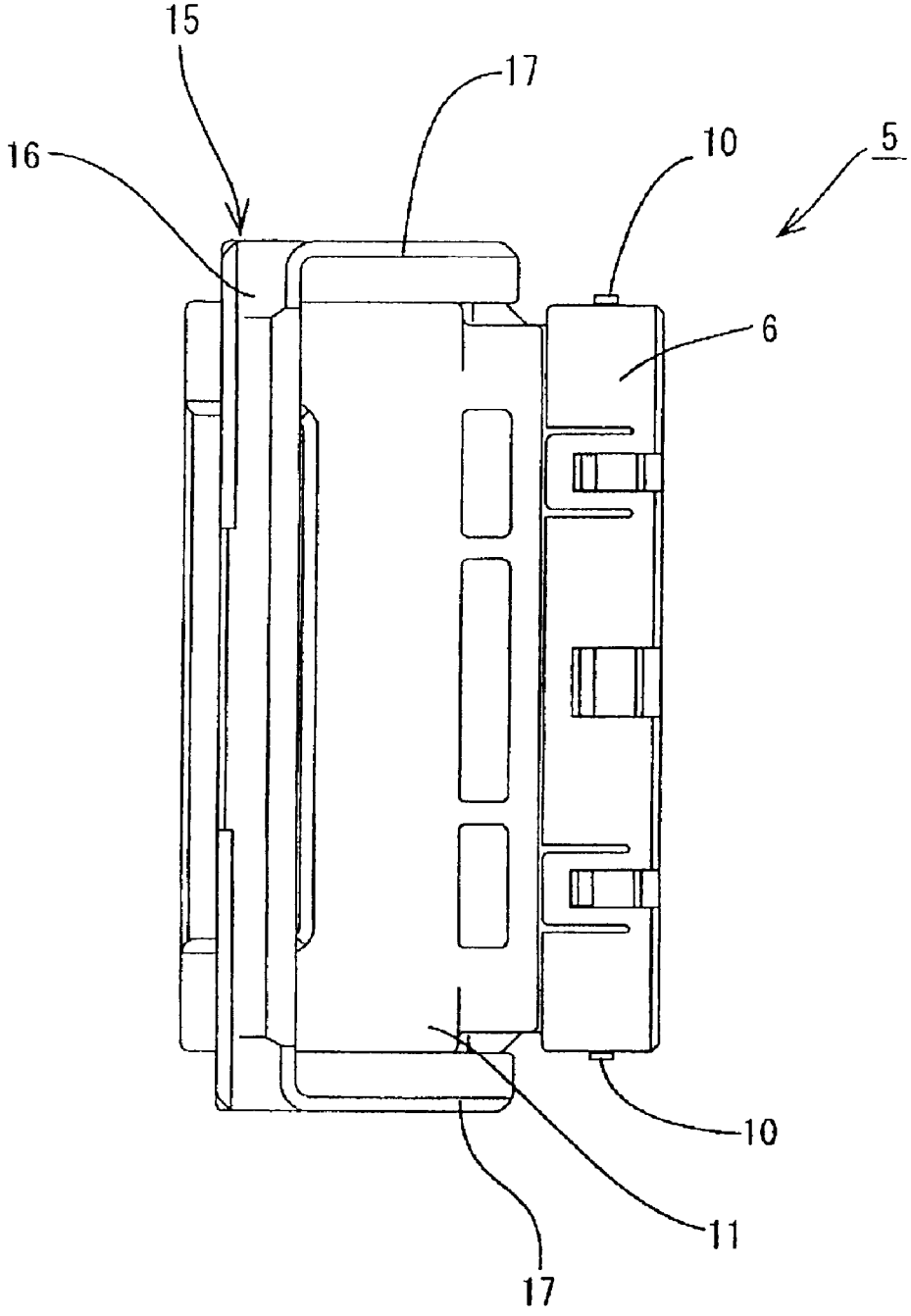
FIG. 2 is a plan view showing the female connector.
Figure 4:
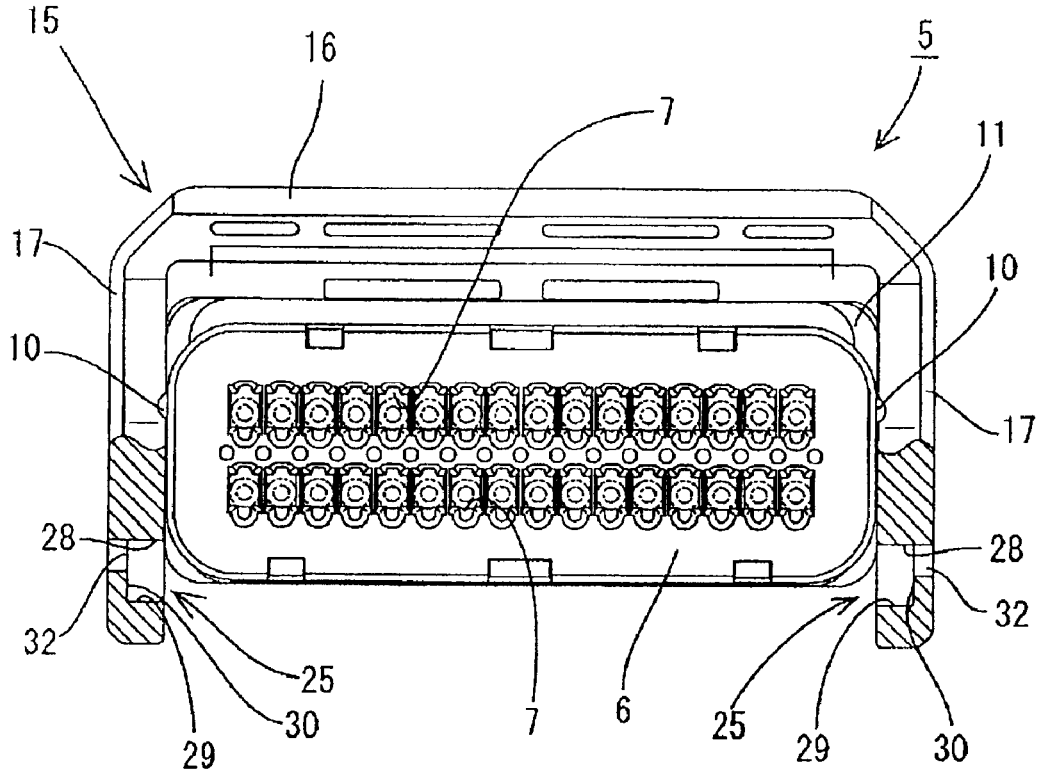
FIG. 4 is a partial cross-sectional view showing the female connector.

As shown in FIGS. 2 through 4, the lever 15 includes a pair of cam plates 17 and an operation part 16 connecting the cam plates 17 to each other. The lever 15 is so disposed as to straddle the hood part 11. A shaft hole 18 is formed in each cam plate 17 at a position near one side edge (i.e., the side edge at the rear side in FIG. 1). The supporting shafts 13 are rotatably inserted into the shaft holes 18.

A cam groove 25 for receiving a cam pin 2 is formed on the inner surface of each cam plate 17. The cam pin 2 is guided along the cam groove 25 when the lever 15 is pivoted. In this way, the female connector 5 and the male connector 1 can be fitted together.

Each cam groove 25 includes an introduction part 26 and a cam part 27. The introduction part 26 is open at a side edge of the cam plate 17 opposite to the position where the shaft hole 18 is formed and extends straight along the fitting direction of the female connector 5 and the male connector 1. The cam part 27 is continuous with the rear end of the introduction part 26 and is formed in a circular arc in such a way that the cam part 27 becomes gradually closer to the shaft hole 18 toward the inward end thereof.

In order to fit the female connector 5 and the male connector 1 together, it is desirable for the cam pin 2 to confront the introduction part 26 of the cam groove 25. The female connector 5 has a construction for temporarily holding the lever 15 at this starting position where the cam pin 2 confronts the introduction part 26. That is, an L-shaped locking part 19, which is flexible inward and outward, is formed on each cam plate 17 by forming thereon two concave grooves 22. A projection 20 is formed on the inner side of the central portion of the locking part 19 (see FIGS. 3 and 7) to releasably hold lever 15 in the starting position.

A cut-out 14 is formed on each side of the hood part 11 at its front end portion in the fitting direction. Before the lever 15 is operated, the projections 20 are locked to the upper edges of the cut-outs 14, as shown in FIG. 3. Thereby the lever 15 is fixed to the position shown in FIG. 1. When the lever 15 is temporarily held, the female connector 5 and the male connector 1 are fitted on each other lightly, i.e., they are placed in a temporary fitted state. In this position, the female terminal fitting and the male terminal fitting are not in contact.

Figure 7:
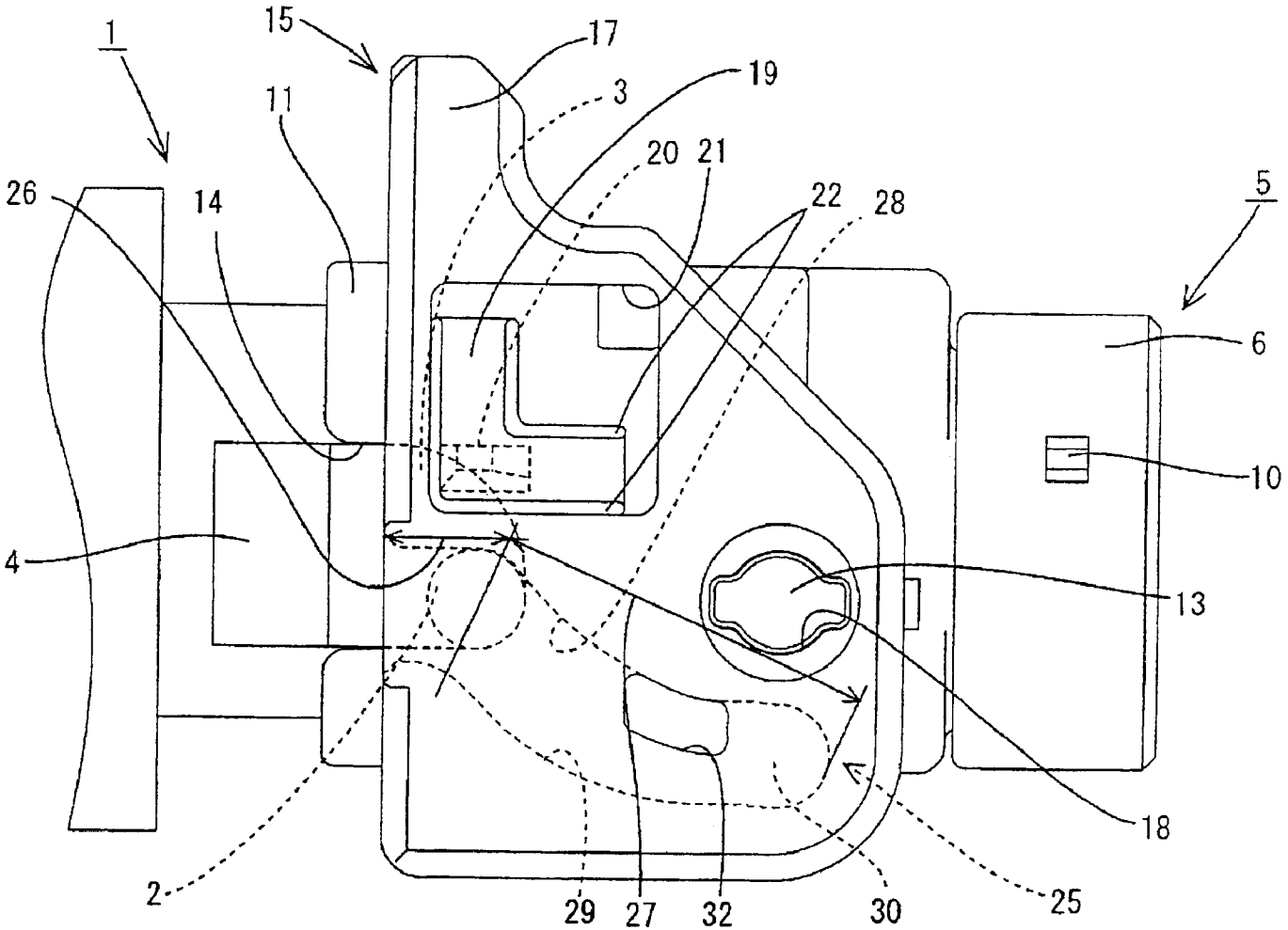
FIG. 7 is a side view showing a state in which the female connector and the male connector are placed at a position where they can be separated from each other.

When the female connector 5 and the male connector 1 are fitted on each other lightly and the cam pins 2 are disposed inside the introduction parts 26, the release parts 3 force the projections 20 outward to unlock the projections 20 from the hood part 11 (see FIG. 7). The lever 15 can then be operated. The front side of the projection 20 is chamfered so that there is a smooth sliding contact between the release part 3 and the projection 20 to flex the locking part 19. The cut-outs 14 provide clearance for the cam pins 2 and the release part 3, when the male connector 1 is fitted into the accommodation space 12.

Figure 5:
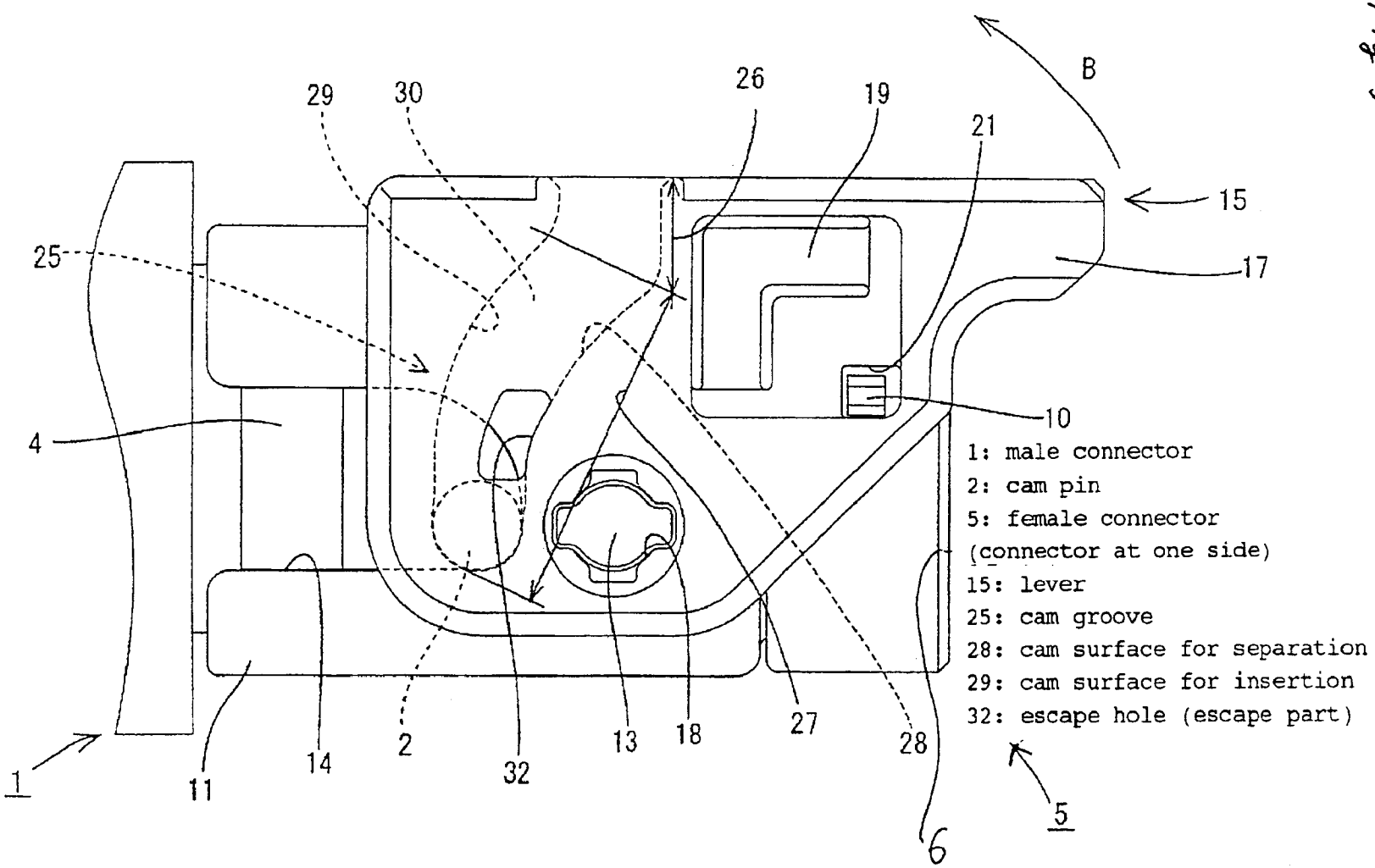
FIG. 5 is a side view showing a state in which the female connector and the male connector are in a fitted state.
Figure 6:
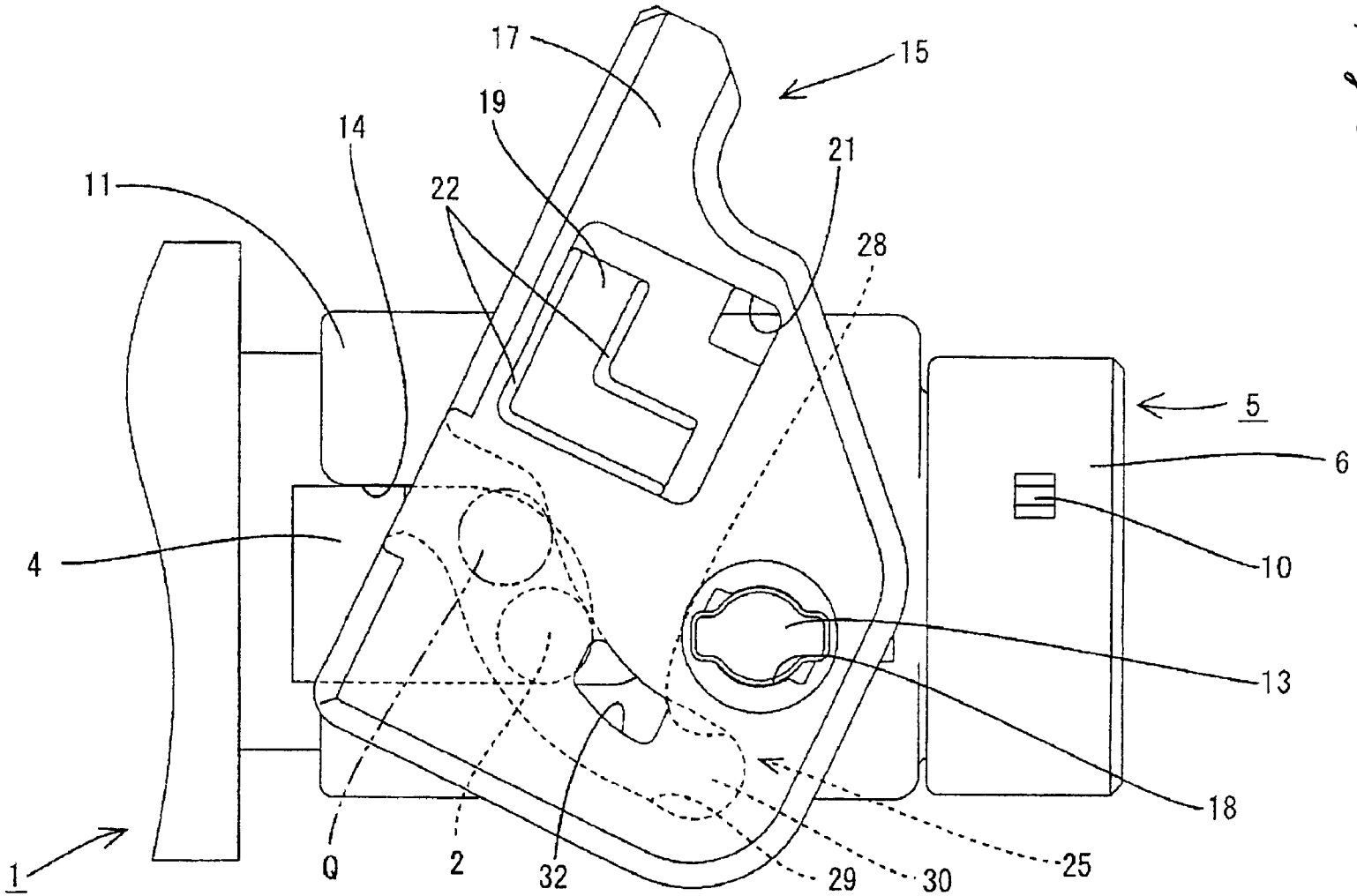
FIG. 6 is a side view showing a state in which the female connector and the male connector are being separated from each other.

A locking hole 21 is formed in both cam plates 17. A locking projection 10 is formed at the rear end of the body 6 on each side. When the female connector 5 and the male connector 1 are fitted together, the lever 15 is pivoted in a direction shown by the arrow A in FIG. 1 to lock the locking holes 21 to the locking projections 10. In this way, as shown in FIG. 5, the female connector 5 and the male connector 1 are locked to each other in a normal fitted state, and the lever 15 is prevented from reversing.

Of the opposed groove surfaces of the cam part 27, the surface closer to the shaft hole 18 serves as a cam surface 28 for separation, whereas the other surface serves as a cam surface 29 for insertion. More specifically, in fitting the female connector 5 and the male connector 1 together, the cam pins 2 slide against the cam surfaces 29 for insertion, whereas in separating the female connector 5 and the male connector 1, the cam pins 2 slides against cam surfaces 28.

The distance between the cam surface 28 for separation and the cam surface 29 for insertion, namely, the groove width of the cam part 27 is larger than the outer diameter of the cam pin 2. The groove width of the cam part 27 becomes smaller toward the inward end thereof. Therefore, the cam pins 2 can be prevented from being loose at the inward end of the cam parts 27.

The introduction part 26 has a constant groove width which is larger than the outer diameter of the cam pin 2. The entrance of the introduction part 26 is trumpet-shaped to receive the cam pin 2 therein easily.

On a bottom surface 30 of the cam part 27, an almost square escape hole 32 is formed through each of the cam plates 17. The escape hole 32 is formed at a position forward of the cam pin 2 when it has reached the inward end of the cam part 27 (FIG. 5). The escape hole 32 is disposed in the bottom surface 30 from the side of the cam surface 28 for separation to a position approximately in the middle of the groove width of the cam part 27.

The operation and effect of the embodiment will be described below. Although not shown in detail, when the female connector 5 and the male connector 1 are fitted on each other lightly, the cam pins 2 are inserted into the introduction parts 26. When the cam pins 2 have reached the inward ends of the introduction parts 26, the locking parts 19 are flexed outward by the release parts 3. As a result, the projections 20 of the locking parts 19 are unlocked from the cut-outs 14. Thereby the lever 15 can be operated (see FIG. 7). The lever 15 is pivoted in the direction shown with the arrow A of FIG. 1. Consequently, the cam pins 2 are guided inside the cam parts 27, with the peripheral surfaces of the cam pins 2 and the cam surfaces 29 for insertion sliding against each other. When the cam pins 2 have reached the inward ends of the cam parts 27, the lever 15 is locked by the locking holes 21 and the locking projections 10. The female connector 5 and the male connector 1 are then held in the normal fitted state.

To separate the female connector 5 and the male connector 1 from each other, both cam parts 27 are flexed a little outward to unlock the locking hole 21 from the locking projection 10. Thereafter, the lever 15 is reversed in a direction (opposite to that in fitted operation) shown by arrow B (FIG. 5). At this time, the cam pins 2 are guided from the inward ends of the cam parts 27 to the introduction parts 26, with the cam pins 2 and the cam surfaces 28 for separation of the cam parts 27 sliding against each other. When the cam pins 2 have reached the introduction parts 26, as shown in FIG. 7, the female connector 5 and the male connector 1 can be separated from each other.

When the lever-type connector is mounted on a buggy or the like, sand or mud may penetrate into the cam grooves 25.

At times, sand stays between the cam pins 2 and the side surfaces of the cam parts 27. In the conventional lever-type connector, when the female connector 5 and the male connector 1 are separated from each other at a maintenance time, the sand causes interference with the operation of the lever 15, which makes it difficult to separate the female connector 5 and the male connector 1 from each other. However, in the present invention, since an escape hole 32 is formed in each cam part 27, the sand passes through the escape holes 32 and is discharged to the outside of the connector before it penetrates into the inward end of the cam part 27. If some sand does not drop through the escape hole 32, but is left in the cam part 27, the groove width of the cam part 27 is larger than the outer diameter of the cam pin 2 to still permit movement of lever 15. Thus compared with the case in which the groove width of the cam part 27 is almost equal to that of the outer diameter of the cam pin 2, the sand does not prevent movement of the cam pin 2. Further, since the groove width of the cam part 27 becomes smaller toward the inward end of the cam part 27, the cam pin 2 is not loose in the cam part 27 in the fitted condition.

At other times, the sand penetrates into a portion in front of the introduction part 26 (cam pin shown by Q in FIG. 6), which causes interference with the operation of the lever 15. The groove width of the introduction part 26 is larger than the outer diameter of the cam pin 2. Thus, an operation of pulling the female connector 5 and the male connector 1 in the separation direction can still be performed. The cam pins 2 can then still be removed from the cam grooves 25, and the female connector 5 and the male connector 1 separated from each other.

Accordingly, when the sand penetrates into the cam grooves 25, the sand does not stay between the surface of the cam grooves 25 and the cam pins 2. Thus the operation of separating the female connector 5 and the male connector 1 from each other can be smoothly performed.

The escape hole 32 is formed at the side of the cam surface 28 for separation to minimize the area of the escape hole 32 in solving the problem of the penetration of the sand into the cam groove. Therefore, it is possible to form the escape hole 32 without deteriorating the strength of the cam plate part 17.

The present invention is not limited to the embodiment described with reference to the drawings, but the following embodiments are included in the technical scope of the present invention. The present invention can be embodied by making various modifications if they do not depart from the gist of the present invention.

(1) In the above-described embodiment, the escape hole 32 is formed as a through-hole. However, the escape hole 32 may be a non-through-hole so long as sand or the like can be dropped thereto.

(2) In the above-described embodiment, the escape hole 32 is formed on the bottom surface of the cam part. However, the escape hole 32 may be formed on side surfaces or side edges of the cam part so long as the escape hole does not interfere with the sliding movement of the cam pin. For example, the escape hole may be formed on a boundary edge between the bottom surface and the cam surface for separation.

(3) In the above-described embodiment, the escape hole is formed at the side of the cam surface for separation. However, the escape hole may have a width equal to the entire width of the cam part so long as the cam plate part has a high strength.

What is claimed is:

1. A lever-type connector comprising a pair of connectors, one of the connectors including a cam pin and the other of the connectors including a lever, the lever having an outer surface and an inner surface, the inner surface having a cam groove for receiving the cam pin so that operation of the lever in one direction draws the connectors together and in an opposite direction separates the connectors, a substantial portion of the cam groove being closed to the outer surface, an escape hole opening in the cam groove and through the outer surface to permit any foreign matter that has penetrated into the cam groove to escape upon movement of the cam pin in the cam groove.

2. A lever-type connector according to claim 1, wherein the lever is pivotally attached to the other of the connectors.

3. A lever-type connector according to claim 2, in which the cam groove includes a pair of spaced apart cam surfaces, wherein a first of the cam surfaces slides against the cam pin when the lever is moved to draw the connectors together and a second of the cam surfaces slides against the cam pin when the lever is moved to separate the connectors, and the escape hole opens in the cam groove near the second cam surface.

4. A lever-type connector according to claim 3, wherein the cam groove has an open end through which the cam pin is received into the cam groove and a closed end where the cam pin is moved when the connectors are fully drawn together, the cam groove has a width that is larger than the width of the cam pin along a substantial portion of the length of the cam groove, and the cam groove narrows to the closed end to closely receive the cam pin therein.

5. A lever-type connector according to claim 1, in which the cam groove includes a pair of spaced apart cam surfaces, wherein a first of the cam surfaces slides against the cam pin when the lever is moved to draw the connectors together and a second of the cam surfaces slides against the cam pin when the lever is moved to separate the connectors, and the escape hole opens in the cam groove near the second cam surface.

6. A lever-type connector according to claim 1, wherein the cam groove has an open end through which the cam pin is received into the cam groove and a closed end where the cam pin is moved when the connectors are fully drawn together, the cam groove has a width that is larger than the width of the cam pin along a substantial portion of the length of the cam groove, and the cam groove narrows to the closed end to closely receive the cam pin therein.

* * * * *